US006646383B2

(12) United States Patent
Bertsche et al.

(10) Patent No.: US 6,646,383 B2
(45) Date of Patent: Nov. 11, 2003

(54) MONOLITHIC STRUCTURE WITH ASYMMETRIC COUPLING

(75) Inventors: Kirk Joseph Bertsche, Fremont, CA (US); Chong-Guo Yao, Pacheco, CA (US)

(73) Assignee: Siemens Medical Solutions USA, Inc., Malvern, PA (US)

( * ) Notice: Subject to any disclaimer, the term of this patent is extended or adjusted under 35 U.S.C. 154(b) by 299 days.

(21) Appl. No.: 09/809,792

(22) Filed: Mar. 15, 2001

(65) Prior Publication Data

US 2002/0158575 A1 Oct. 31, 2002

(51) Int. Cl.[7] ..... H01J 25/10; H01J 25/34

(52) U.S. Cl. ..... 315/5.41; 315/5.39; 315/505; 315/500; 315/111.61

(58) Field of Search ..... 315/5.41, 5.39, 315/505, 500, 111.61

(56) References Cited

U.S. PATENT DOCUMENTS

| | | | | |
|---|---|---|---|---|
| 4,162,423 A | | 7/1979 | Tran | 315/5.41 |
| 4,286,192 A | | 8/1981 | Tanabe et al. | 315/5.41 |
| 4,382,208 A | | 5/1983 | Meddaugh et al. | 315/5.42 |
| 4,400,650 A | | 8/1983 | Giebeler, Jr. | 315/5.41 |
| 4,629,938 A | | 12/1986 | Whitman | 315/5.41 |
| 4,651,057 A | | 3/1987 | Uetomi et al. | 315/5.41 |
| 4,746,839 A | | 5/1988 | Kazusa et al. | 315/5.41 |
| 5,039,910 A | * | 8/1991 | Moriguchi et al. | 315/5.41 |
| 5,734,168 A | | 3/1998 | Yao | 250/492.3 |
| 5,821,694 A | | 10/1998 | Young | 315/5.41 |
| 6,376,990 B1 | * | 4/2002 | Allen et al. | 315/5.41 |

FOREIGN PATENT DOCUMENTS

| | | |
|---|---|---|
| GB | 2334139 A | 11/1999 |
| GB | 2354875 A | 4/2001 |

* cited by examiner

*Primary Examiner*—Nikita Wells

(57) ABSTRACT

A device for use in a linear accelerator operable to accelerate charged particles along a beam axis is disclosed. The device includes a plurality of monolithic members connected to form a series of accelerating cavities aligned along the beam axis and coupling cavities. Each of the coupling cavities intersects with adjacent accelerating cavities at first and second coupling apertures. The first and second coupling apertures have different sizes.

10 Claims, 5 Drawing Sheets

MONOLITHIC STRUCTURE WITH ASYMMETRIC COUPLING

FIELD OF THE INVENTION

The present invention relates generally to a radiation emitting device, and more particularly to a linear accelerator having a monolithic cavity structure with asymmetric coupling.

BACKGROUND OF THE INVENTION

Linear accelerators are used to accelerate a variety of particles (e.g., electrons, protons, ions) for numerous applications, such as radiation therapy. A radiation therapy device generally includes a gantry which can be swiveled around a horizontal axis of rotation in the course of a therapeutic treatment. An electron linear accelerator is located within the gantry for generating a high energy radiation beam for therapy. This high energy radiation beam may be an electron beam or photon (x-ray) beam, for example. During treatment, the radiation beam is trained on a zone of a patient lying in the isocenter of the gantry rotation.

Linear accelerators may be used in the medical environment for a variety of applications. A beam of charged particles, e.g., electrons, from a linear accelerator may be directed at a target which is made of a material having a high atomic number, so that an X-ray beam is produced for radiation therapy. Alternatively, the beam of charged particles may be applied directly to a patient during a radiosurgical procedure. Such radio surgery has become a well-established therapy in the treatment of brain tumors. A high-energy beam may be directed at a localized region to cause a breakdown of one or both strands of the DNA molecule inside cancer cells, with the goal of at least retarding further growth and preferably providing curative cancer treatment.

A conventional linear accelerator includes a series of accelerating cavities that are aligned along a beam axis. A particle source, which for an electron accelerator is typically an electron gun, directs charged particles into the first accelerating cavity. As the charged particles travel through the succession of accelerating cavities, the particles are focused and accelerated by means of an electromagnetic field. For example, a radio frequency (RF) source may be coupled to the accelerator to generate the necessary field to operate the linear accelerator. The accelerated particles from a clinical linear accelerator have a high energy (e.g., up to 20 MeV). Often, the output beam is directed to a magnetic bending system that functions as an energy filter. The beam is typically bent by approximately 270 degrees. Then either the output beam of high energy particles or an X-ray beam generated by impinging a target with the output beam is employed for radiation treatment of a patient.

The frequency of the driving signal and the dimensions of the accelerating cavities and the beam passages between adjacent accelerating cavities determine the operating frequency of the accelerator. Optimal performance of the accelerator requires a match between the resonant frequency of the cavity structure and the frequency of the driving signal.

In a resonant chain of coupled cavities such as used in a standing-wave linear particle accelerator, it is often desirable to change the field strength in some cavities relative to other cavities. Adjustment of the field strength profile in an accelerator can be done by changing the coupling constants on each side of a coupling cavity. This is typically done by shifting the side cavity's longitudinal position, which makes the coupling aperture larger on one side and smaller on the other. In doing this, the side cavity's shape is generally unchanged. The side cavity remains symmetrical. This conventional method works well for accelerator designs where the side cavity is manufactured as one piece and attached to a piece which contains two main cavity halves.

An alternative method for manufacturing the accelerator structures is to form monolithic members such as disclosed in U.S. Pat. No. 5,734,168, by Yao, which is incorporated herein by reference in its entirety. The monolithic structure defines a portion of the main cavity and side cavity in one structure. The monolithic structure provides improvements in manufacturing such as reduced tolerances and reduced manufacturing costs, especially for higher frequency accelerators. One drawback with the monolithic structure is that the field strength adjustment as described above cannot be used. If the side cavity is shifted longitudinally, the unit cell will not contain exactly one half of a side cavity, and the frequency of this partial side cavity will be significantly shifted from the frequency of the full side cavity. This complicates the design and testing of cavities.

There is, therefore, a need for a monolithic cell structure that allows for adjustment of the field strength by modifying the side cavity configuration to vary the coupling constant between a side cavity and a main cavity.

SUMMARY OF THE INVENTION

A device for use in a linear accelerator operable to accelerate charged particles along a beam axis is disclosed. The device includes a plurality of monolithic members connected to form a series of accelerating cavities aligned along the beam axis and coupling cavities. Each of the coupling cavities intersects with adjacent accelerating cavities at first and second coupling apertures. The first and second coupling apertures have different sizes.

In another aspect of the invention, a system for delivering charged particles for medical applications generally comprises a particle accelerator having an input for connection to a source of charged particles and a plurality of accelerating cells. The particle accelerator has a beam path extending through the cells to an exit window. Each of the particle accelerating cells comprises an accelerating cavity half cell and a coupling cavity half cell. The particle accelerating cells are connected to form a series of accelerating cavities aligned along the beam axis and coupling cavities. Each of the coupling cavities intersects with adjacent accelerating cavities at first and second coupling apertures. The first and second coupling apertures have different sizes. The system further includes a signal source for energy transfer engagement with the charged particles within the particle accelerator.

The above is a brief description of some deficiencies in the prior art and advantages of the present invention. Other features, advantages, and embodiments of the invention will be apparent to those skilled in the art from the following description, drawings, and claims.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

The following description is presented to enable one of ordinary skill in the art to make and use the invention. Descriptions of specific embodiments and applications are provided only as examples and various modifications will be readily apparent to those skilled in the art. The general principles described herein may be applied to other embodiments and applications without departing from the scope of the invention. Thus, the present invention is not to be limited to the embodiments shown, but is to be accorded the widest scope consistent with the principles and features described herein. For purpose of clarity, details relating to technical material that is known in the technical fields related to the invention have not been described in detail.

Figure 1:
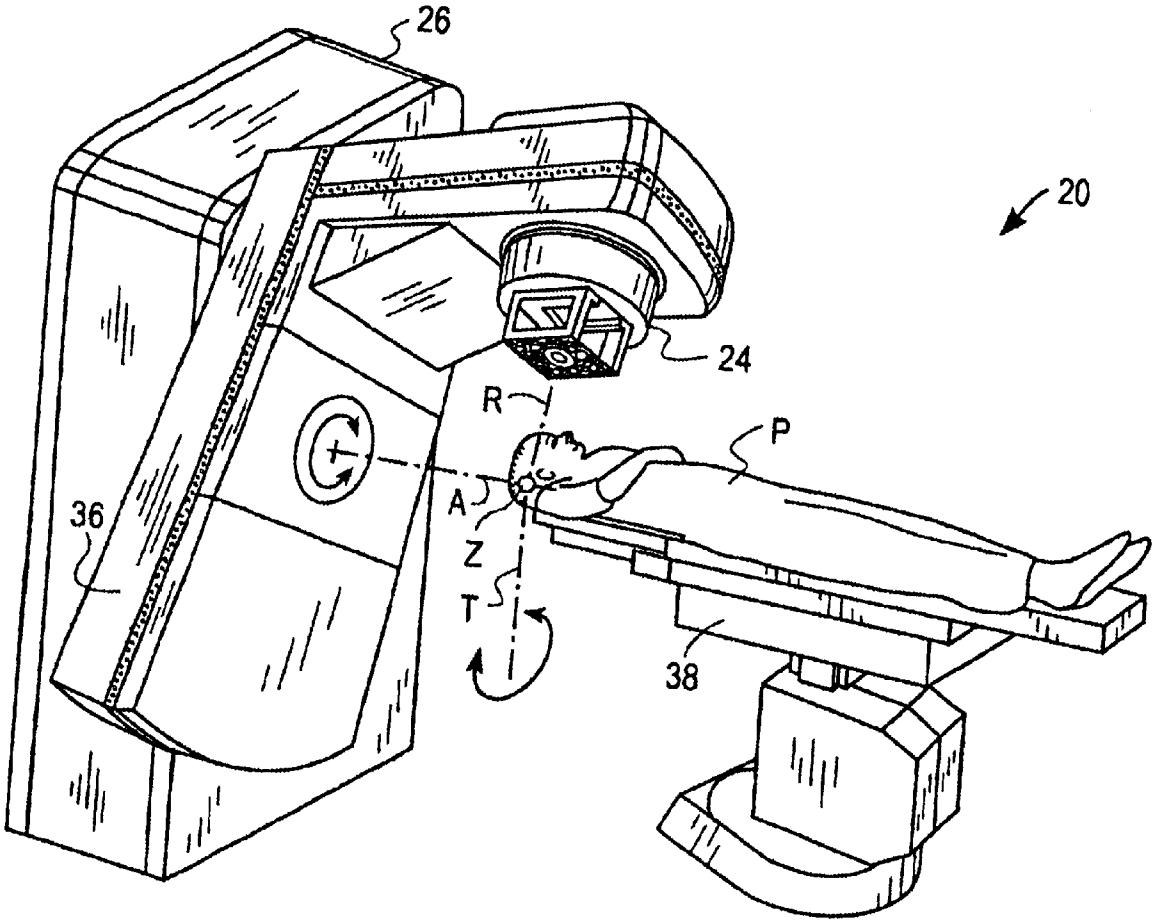
FIG. 1 is a diagram of a radiation treatment device having a linear accelerator according to an embodiment of the present invention and a patient positioned for treatment within the treatment device.

Referring now to the drawings, and first to FIG. 1, a radiation treatment device of the present invention is shown and generally indicated at 20. The radiation treatment device 20 includes a beam shielding device within a treatment head 24, a control unit within a housing 26 connected to a treatment processing unit (not shown). The radiation treatment device further includes a gantry 36 which can be swiveled for rotation about axis A in the course of a therapeutic treatment. The treatment head 24 is fixed to the gantry 36 for movement therewith and a linear accelerator is located within the gantry for generating high powered radiation used for therapy. The radiation emitted from the linear accelerator extends generally along axis R. Electron, photon, or any other detectable radiation may be used for the therapy. During treatment, the radiation beam is focused on a zone Z of an object P (e.g., a patient who is to be treated). The zone to be treated is located at an isocenter defined by the intersection of the rotational axis A of the gantry 36, rotational axis T of treatment table 38, and the radiation beam axis R. The treatment device 20 described above is provided as an example of a device for use in delivering a treatment with a linear accelerator having a monolithic structure as described below. It is to be understood that the radiation treatment device may be different than the one shown in FIG. 1 without departing from the scope of the invention.

Figure 2:
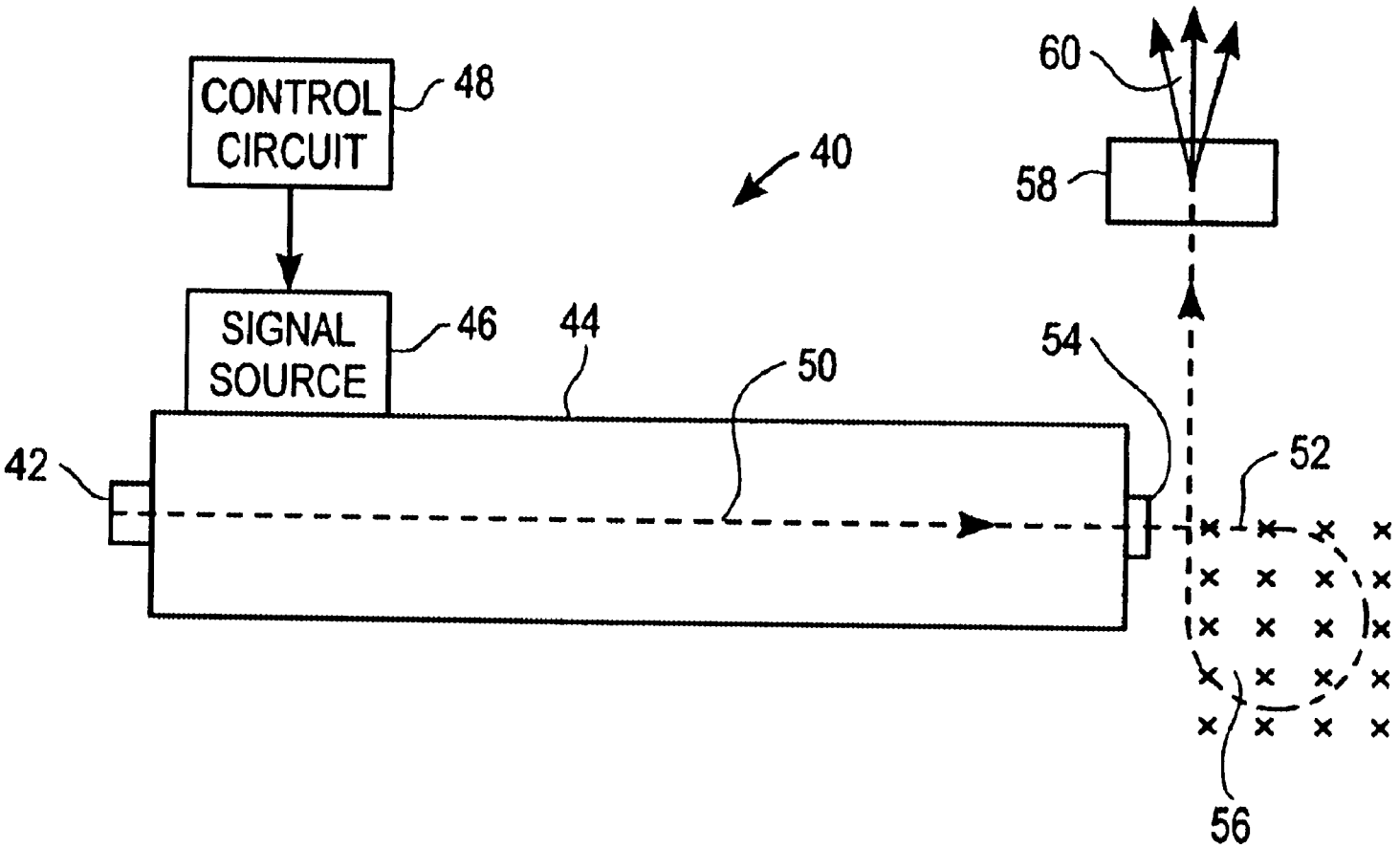
FIG. 2 is a schematic of a linear accelerator of the radiation treatment device of FIG. 1.

FIG. 2 illustrates additional detail of the linear accelerator of the treatment device of FIG. 1. The linear accelerator includes a particle source 42 for directing charged particles into an accelerator device 44. In a preferred embodiment, the particle source is an electron gun which injects electrons into the input end of the accelerator device 44. A driving source is introduced into the accelerator device by a signal source 46. The signal source 46 introduces an electromagnetic wave having a suitable frequency. Radio frequency or high frequency sources are conventionally employed, but the selection of the frequency of the drive signal is not critical to the invention. Optionally, the frequency may be dynamically controlled by a control circuit 48 that is connected within a closed loop system (not shown).

Electrons introduced into the accelerator device 44 by the electron gun are accelerated along the beam axis 50 of the device. The electrons obtain a high energy by virtue of the energy-transfer relationship with the electromagnetic waves established by connection with the signal source 46. A pulsed or steady state output beam of the electrons is emitted from an exit window 54, which is located at the delivery end of the device 44. The exit window 54 may include a thin metal foil. The output beam 52 of charged particles is directed to an achromatic magnetic bending system 56, which acts as an energy filter. The output beam is bent by approximately 270 degrees and is then directed onto a target 58 such as a gold or tungsten target. Impingement of the target 58 by the output beam 52 generates an X-ray beam which is employed for radiation treatment of a patient. Alternatively, the output beam 52 may be applied directly to a patient such as during a radiosurgical procedure to treat a brain tumor. The operations of the magnetic bending system 56 and the target 58 are well known by those skilled in the art.

Figure 3:
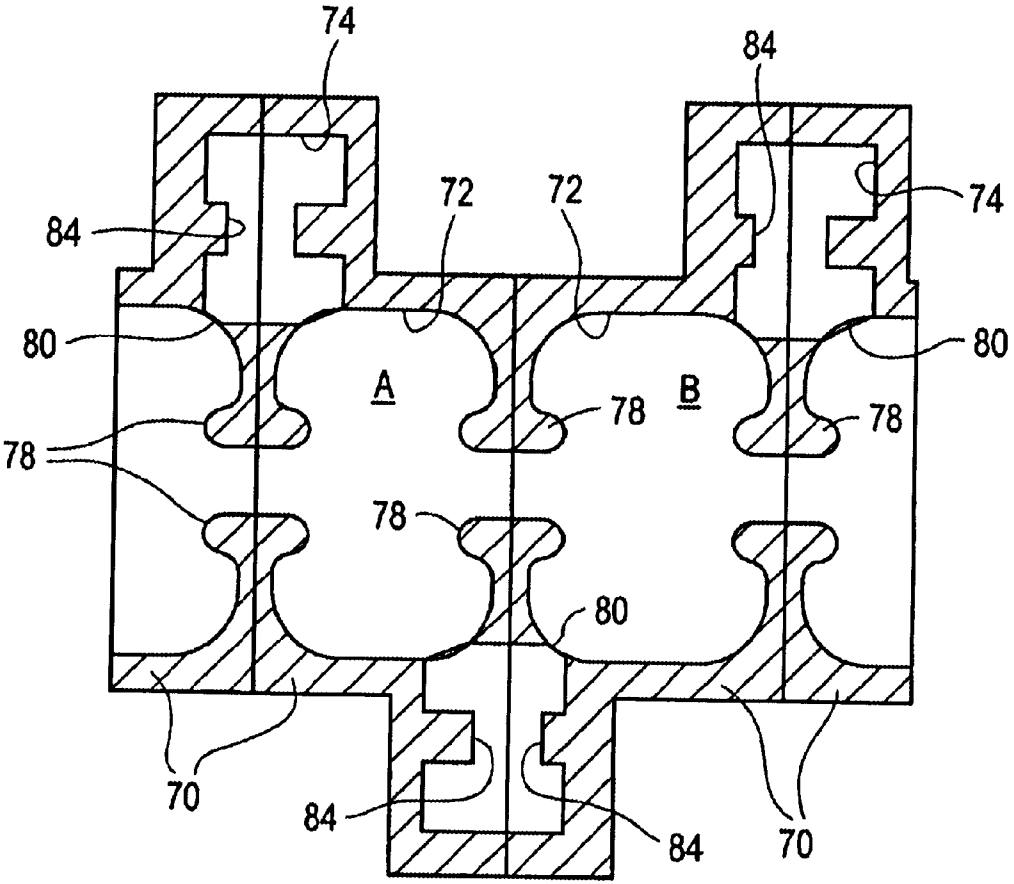
FIG. 3 is a side sectional view of a series of monolithic members of the present invention that are connected to form a linear accelerator.

Referring now to FIG. 3, a side sectional view of a series of monolithic members 70 of the present invention is shown. The monolithic members 70 are connected together to form the linear accelerator. As shown in FIG. 3, two connected members 70 define a main accelerating cavity 72 and a side coupling cavity 74. The accelerating cavities 72 are aligned to permit passage of beam 50 (FIGS. 2 and 3). The accelerating cavities 72 include projecting noses 78 which are used to improve efficiency of interaction of microwave power and electron beam. The side cavities 74 are used to electromagnetically couple the accelerating cavities 72. The intersection region of the side cavity 74 with the acceleration cavity 72 is referred to as an iris (or coupling aperture) 80.

Figure 4:
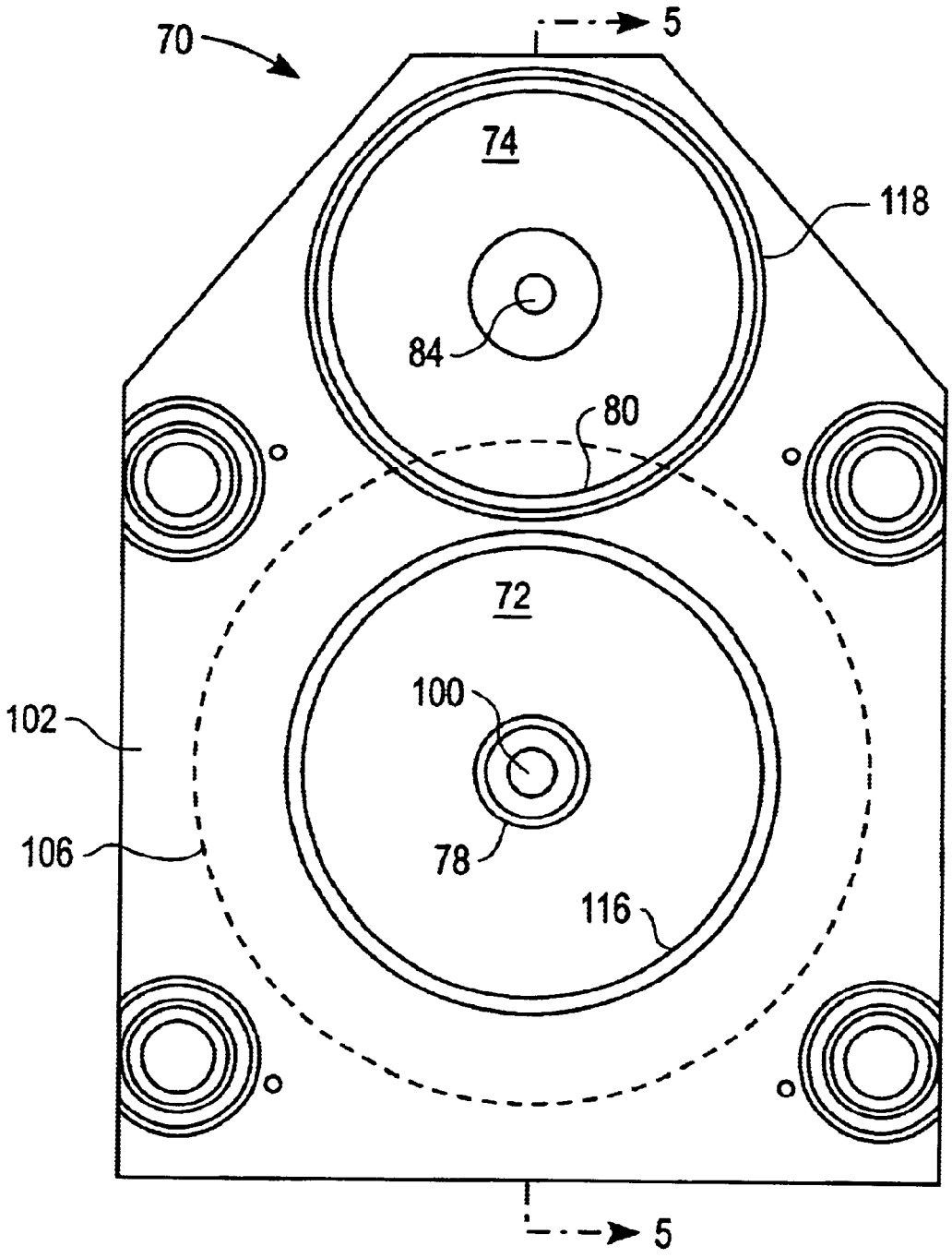
FIG. 4 is a front view of the monolithic member of FIG. 3.
Figure 5:
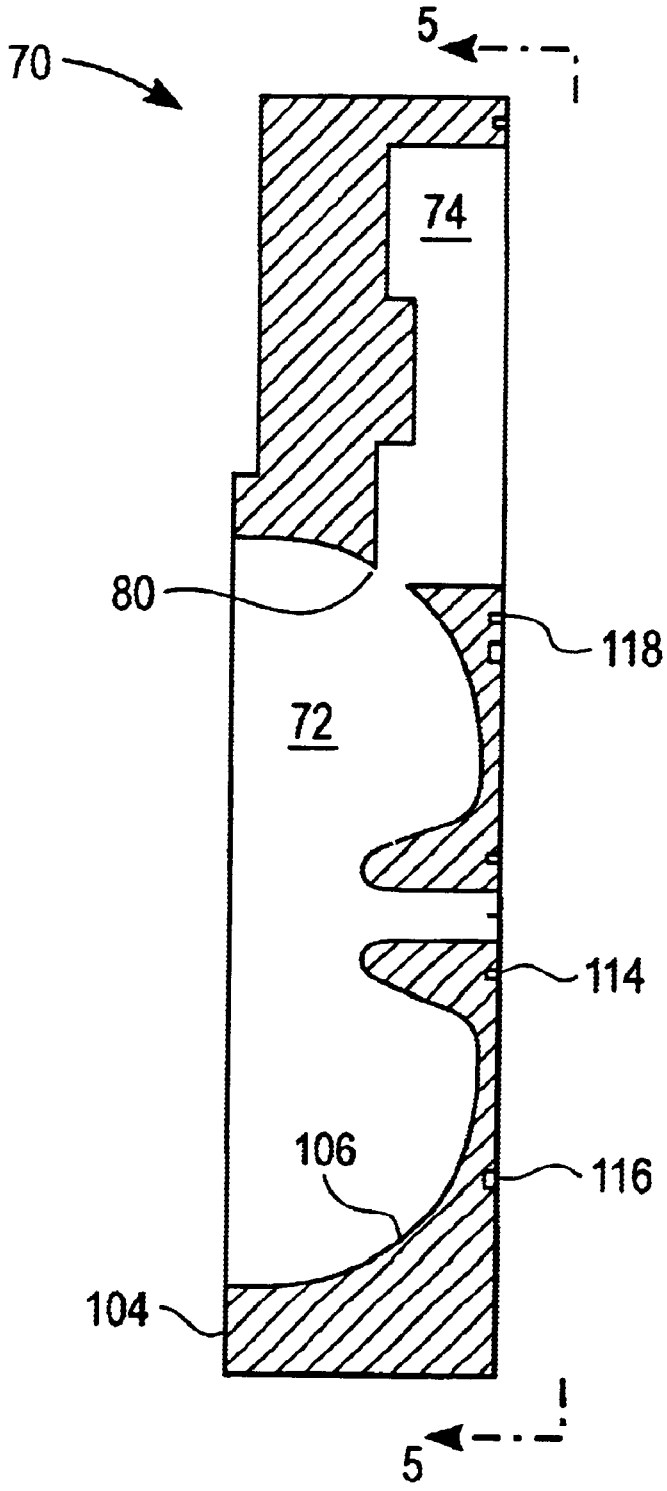
FIG. 5 is a side sectional view of the monolithic member of FIG. 4 taken along lines 5—5.

Referring now to FIGS. 4 and 5, an individual monolithic member (half cell) 70 is shown. The member 70 includes a beam axis opening 100 which extends from a first face 102 of the monolithic member to the interior of the monolithic member. A second face is contoured to provide an abutment region 104 and a cavity-defining region 106. The cavity-defining region 106 preferably has a generally circular cross-section.

As previously discussed, the member 70 is a monolithic side coupled structure. The side coupling is achieved on the member shown in FIGS. 4 and by means of an upper portion of the monolithic member. This upper portion is machined to provide the coupling cavity 74. After pieces are assembled together, the coupling cavity 74 is off-axis of the electron beam and is connected to the accelerating cavity of the monolithic member by an opening (iris) 80. The coupling cavity 74 is connected to each of two accelerating cavities 72. Consequently, when a drive signal having the appropriate frequency is fed to any cavity in the structure, the electromagnetic waves are in an energy transfer relationship with an electron beam that is directed through the accelerating cavities 72. The beam 50 of charged particles passes through each of the accelerating cavities 72 and is focused and accelerated. The exit velocity of the output beam 52 is determined by a number of factors, including the number of accelerating cavities 72 within the accelerator device 40.

The members 70 are interconnected using a brazing process. Wire of brazing material is introduced into grooves and activated using conventional techniques. One example of a brazing material is the alloy made of Ag, Pd, and Ga. The contents may be 82% Ag, 9% Pd, and 9% Ga, for example. Circular grooves 114, 116 are formed concentrically about the beam axis opening 100. These openings are filled with the braze material during the interconnection of the monolithic half cell members. There is also a circular groove 118 for braze material at the upper portion of the monolithic member 70.

The accelerating device of FIG. 3 preferably operates in the standing wave mode that is referred to as a half-$\pi$ mode (also known as $\pi/2$ mode). The frequency of excitation is such that the series of connected structures is excited in a standing wave resonance with $\pi/2$ radians phase shift between each accelerating cavity 72 and the adjacent side cavity 74. A linear accelerator operated in half-$\pi$ mode has side cavities 74 that are nominally unexcited and main accelerating cavities 72 with strong fields. When properly tuned (so that the side cavities are unexcited), the ratio of field strengths in adjoining main cavities 72 are determined by the coupling coefficients between the main cavities and the common side cavity 74 which connects them. The coupling cavities 74 are preferably resonant at roughly the same frequency as the accelerating cavities 72.

More specifically, if coupling constants between two adjacent main cavities (A, B) and the connecting side cavities are $k_A$ and $k_B$, and the stored energy in the main cavities is $U_A$ and $U_B$, the ratio of stored energies is given by:

$$\frac{U_B}{U_A} = \left(\frac{k_A}{k_B}\right)^2$$

where:

$U_A$: stored energy in cavity A;

$U_B$: stored energy in cavity B;

$k_A$: coupling constant between cavity A and the connecting side cavity; and $k_B$: coupling constant between cavity B and the connecting side cavity.

The above equation holds for main cavities 72 of different shape or volume. If the two main cavities are identical, the field ratio is proportional to the square root of the stored energy ratio, so it is just proportional to the inverse of the coupling ratio:

$$\frac{E_B}{E_A} = \frac{k_A}{k_B}$$

where:

$E_A$: maximum longitudinal electric field strength in cavity A;

$E_B$: maximum longitudinal electric field strength in cavity B;

$k_A$: coupling constant between cavity A and the connecting side cavity; and $k_B$: coupling constant between cavity B and the connecting side cavity.

One method for adjusting field strength in conventional non-monolithic structures is to shift the side cavity's longitudinal position, which results in a larger coupling aperture (iris) on one side and a smaller iris on the other side. However, if the side cavity is shifted longitudinally, the member 70 will not contain exactly one half of a side cavity 74, and the frequency of this partial side cavity will be significantly shifted from the frequency of the full side cavity. This complicates the design and testing of cavities.

The present invention resolves this problem by designing the side cavities 74 to be longitudinally asymmetric. The partial side cavity on each monolithic member 70 has its post 84 height adjusted to make each partial side cavity resonant at the identical desired frequency. This assists in the cold testing of the monolithic members, by simplifying the measurements of frequencies and coupling constants. The coupling constant may be adjusted in the design phase by changing the depth of the partial side cavity, while at the same time changing its post height to keep its frequency constant.

The size of the coupling aperture 80 may be determined through use of a simulation software such as Superfish, available from Los Alamos, National Laboratory, which calculates resonant frequency of a two dimensional cavity, as is well known by those skilled in the art. This can be used to calculate the initial post 84 height. Alternatively a three dimensional simulation code that accounts for the size and shape of the iris 80 may be used.

Although the present invention has been described in accordance with the embodiments shown, one of ordinary skill in the art will readily recognize that there could be variations to the embodiment and these variations would be within the spirit and scope of the present invention. Accordingly, many modifications may be made by one of ordinary skill in the art without departing from the spirit and scope of the appended claims.

What is claimed is:

1. A device for use in a linear accelerator operable to accelerate charged particles along a beam axis, the device comprising a plurality of monolithic members connected to form a series of accelerating cavities aligned along said beam axis and coupling cavities, each of said coupling cavities intersecting with adjacent accelerating cavities at first and second coupling apertures, at least one pair of said first and second coupling apertures having a different size, wherein two adjacent cavity defining monolithic members include two opposing posts extending longitudinally into said coupling cavity and wherein each of the posts is configured such that the resonant frequency of a partial coupling cavity in one of the members is generally equal to the resonant frequency of a partial coupling cavity in the other member.

2. The device of claim 1 wherein the monolithic member of the adjacent members having a larger coupling aperture has a longer post height.

3. The device of claim 1 wherein the device is configured for operation in half-π mode.

4. The device of claim 1 wherein the monolithic members are brazed together.

5. The device of claim 1 wherein the device is configured for use in medical applications.

6. A system for delivering charged particles, the system comprising:

a particle accelerator having an input for connection to a source of charged particles and a plurality of particle accelerating cells, the particle accelerator having a beam path extending through said cells to an exit window, each of said particle accelerating cells comprising an integral accelerating cavity half cell and a coupling cavity half cell, the particle accelerating cells connected to form a series of accelerating cavities aligned along said beam axis and coupling cavities, each of said coupling cavities intersecting with adjacent accelerating cavities at first and second coupling apertures, said first and second coupling apertures having a different size, wherein two adjacent particle accelerating cells include two opposing posts extending longitudinally into said coupling cavity, each of the posts being configured such that the resonant frequency in one half partial coupling cavity is generally equal to the resonant frequency in the other partial coupling cavity; and a signal source for energy transfer engagement with the charged particles within the particle accelerator.

7. The system of claim 6 wherein the particle accelerating cell of the adjacent cells having a larger coupling aperture has a longer post height.

8. The system of claim 6 wherein the particle accelerator is configured for operation in half-π mode.

9. The system of claim 6 wherein the particle accelerating cells are brazed together.

10. The system of claim 6 wherein the system is configured for use in medical applications.

* * * * *